US005226809A

United States Patent [19]

Franco

[11] Patent Number: 5,226,809

[45] Date of Patent: Jul. 13, 1993

[54] SECURITY FASTENER APPLICATION

[75] Inventor: Gino Franco, Santa Clarita, Calif.

[73] Assignee: Precision Dynamics Corporation, San Fernando, Calif.

[21] Appl. No.: 819,280

[22] Filed: Jan. 13, 1992

[51] Int. Cl.[5] ..... A44B 17/00; G09F 3/00

[52] U.S. Cl. ..... 24/704.1; 24/662; 40/625

[58] Field of Search ..... 24/704.1, 704.2, 297, 24/306, 662, 324, 665; 40/625; 411/512

[56] References Cited

U.S. PATENT DOCUMENTS

| | | | |
|---|---|---|---|
| 1,964,847 | 7/1934 | Engler et al. | 24/704.1 |
| 2,943,373 | 7/1960 | Rapata | 24/662 |
| 3,210,820 | 10/1965 | Humiston | 24/704.1 |
| 3,362,280 | 1/1968 | Muller | 24/704.1 |
| 3,551,963 | 1/1971 | Mosher, Jr. et al. | 411/512 |
| 3,751,056 | 8/1973 | Wightman | 24/662 |
| 4,221,063 | 9/1980 | Charles et al. | 40/625 |
| 4,233,715 | 11/1980 | McDermott | 24/704.1 |

FOREIGN PATENT DOCUMENTS

| | | | |
|---|---|---|---|
| 0805194 | 5/1951 | Fed. Rep. of Germany | 24/704.1 |
| 1450901 | 3/1969 | Fed. Rep. of Germany | 24/297 |
| 1220181 | 5/1960 | France | 24/297 |

*Primary Examiner*—Victor N. Sakran
*Attorney, Agent, or Firm*—Thomas P. Mahoney

[57] ABSTRACT

A security fastener for non-releasably securing an identification band to a person or object which includes carrier means located inside the lower extremity of said band, the carrier means incorporating fastener means insertable through openings in the upper and lower extremities of the band. Receptor means is provided in a security shroud which overlies the upper extremity of the band, locking means being engagable with the fastener means to maintain said shroud in said overlying relationship.

9 Claims, 2 Drawing Sheets

SECURITY FASTENER APPLICATION

This invention relates to a security fastener for use with various devices, such as identification bands, luggage tags, security seals, and the like.

BACKGROUND OF THE INVENTION

Recent developments in patient identification bands, crowd control bands, and analogous products have resulted in the development of various types of security fasteners intended to prevent the removal of the bands without either the destruction of the bands or the destruction of the fasteners.

Typical security fasteners have included various types of metallic fasteners and metallic and plastic snap fasteners in which a male stud is inserted into a female receptor.

Unfortunately, most of the prior art security fasteners have been subject to tampering because the components of the fasteners are exposed and the ever-ingenious individuals upon whom such fasteners are utilized will, inevitably, determine a mode of separating the components of the fasteners to release the bands or other articles secured by said fasteners.

One of the most successful approaches to the solution of these problems is disclosed in U.S. Pat. No. 4,221,063 wherein a security band intended for use in prisons, mental institutions, and the like is disclosed. Various types of metallic fasteners are provided which include metallic studs adapted to be deformed into underlying relationship with the opposite extremities of the band or other identification means.

Therefore, secure affixation of the security band to a prisoner or patient is achieved. However, the components of the security fastener affixing the band to the individual are visible and the inevitable tampering with the security fastener occurs, sometimes resulting in the successful removal of the security fastener from operative relationship with the band. In some instances, such tampering is not perceptible and prisoners and patients frequently trade bands for various purposes, such as deceiving the guards in prisons as to the status of a prisoner or to permit a mental patient to access portions of an institution which he is not permitted to access.

Another type of security fastener is disclosed in U.S. Pat. No. 3,551,963, wherein a snap fastener incorporates detent means for maintaining the snap fastener in locking relationship with a hospital identification band or the like. Once again, tampering with the fasteners occurs because the juncture between the male and female components of the fastener is visually perceptible by an individual upon whom a hospital identification or crowd control band has been placed.

OBJECTS AND ADVANTAGES OF THE INVENTION

It is, therefore, an object of the invention to provide a security fastener which is characterized by a security capsule having a shroud with retention means therein adapted to cooperate with another component of the fastener constituted by stud means having detent mean receivable in locking relationship with said retention means. When the security capsule is installed in operative relationship with the stud means and an identification band, the juncture between the stud means and the retention means is concealed and, thus, the tampering which occurs when such junctures are visible is substantially reduced.

Another object of my invention is the provision of a security fastener wherein the capsule is constituted by a block having the retention means therein and a shroud in which said block is permanently secured, said block and shroud combination being disposable over a cooperative stud to maintain the opposite extremities of an identification band in operative relationship with the wrist or other body part of a patient or other individual.

An additional object of the invention is the provision of a security fastener wherein tampering with the capsule is readily evident because any attempt to remove the capsule will result in either destruction or elimination of the capsule from operative relationship with the corresponding stud, thus permitting the attendants to readily perceive the absence of the security fastener.

A further object of the invention is the provision of a security fastener of the aforementioned type in which the security capsule is provided in a wide variety of different colorations readily distinguishable from the coloration of the band or other object to which the security fastener or capsule is affixed, thus permitting an attendant or other individual to readily perceive the absence of the capsule from cooperative relationship with the band or other object to which it is affixed.

BRIEF DESCRIPTION OF THE DRAWINGS

Other objects and advantages of the invention will be apparent from the following specification and the accompanying drawings in which.

DESCRIPTION OF THE PREFERRED EMBODIMENT OF THE INVENTION

Figure 1:
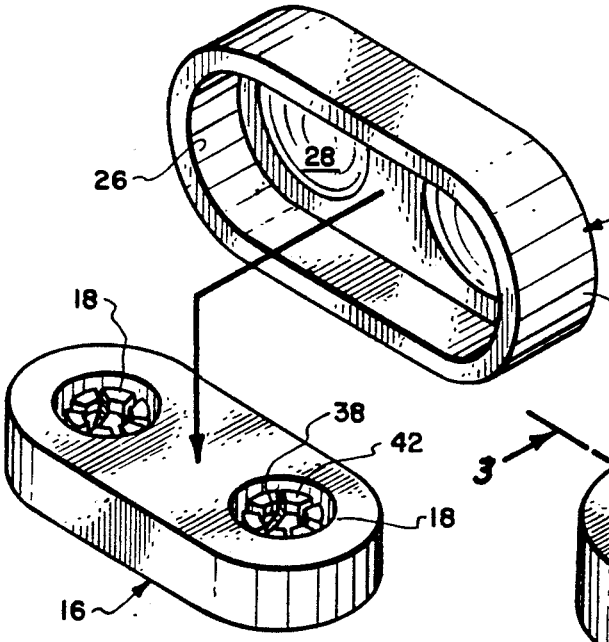
FIG. 1 is a view showing the capsule components.
Figure 2:
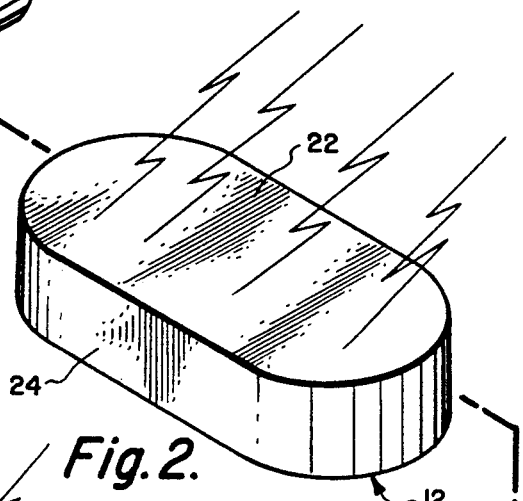
FIG. 2 is a view illustrating the sonic securement of the capsule components to one another.
Figure 3:
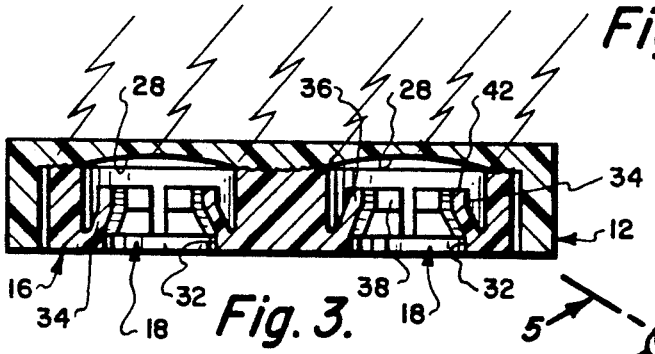
FIG. 3 is a cross-sectional view showing the capsule component secured to one another.
Figure 4:
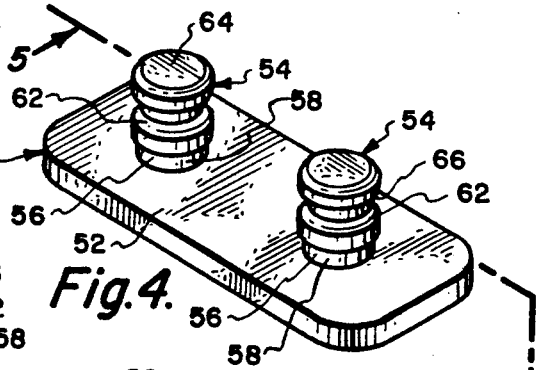
FIG. 4 is an isometric view illustrating the stud means of the security fastener.
Figure 5:
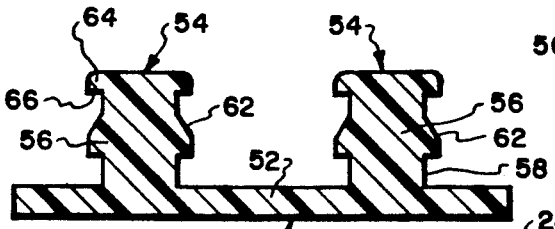
FIG. 5 is a sectional view taken on the broken line 5—5 of FIG. 4.

Referring to the drawings and, in particular, to FIGS. 1-5 and 8 thereof, I show a security fastener 10, said fastener including a capsule 12, having a shroud 14 incorporating a mounting block 16.

The security fastener 10 is disclosed as incorporating a plurality of receptor means 18 in the mounting block 16, but it would be obvious to those skilled in the art that one or more receptor means 18 and corresponding components of the security fastener 10, to be described in greater detail below, can be incorporated in the security fastener 10.

Furthermore, the capsule 12 is disclosed as being elliptical in shape, but it will be obvious, once again, to those skilled in the art that the precise configuration of the capsule can be altered to meet the specific needs of the application in which it is intended to be utilized.

The shroud 14 and mounting block 16 can be fabricated from synthetic plastics, such as polyethylene, or other materials, but it is not intended that the manufacture thereof be limited to any particular material.

The shroud 14 includes a flat top wall 22 and a circumferential, depending skirt 24 which, as best shown in FIG. 1 of the drawings, define a chamber 26 which is of substantially the same size and configuration as the mounting block 16 and which has formed on the underside of the top wall 22 concavities 28 for a purpose which will be described in greater detail below.

The shroud 14 and mounting block 16 are fabricated by injection molding and, after the mounting block I6 is inserted in the chamber 26, the assembled components are subjected to sonic welding, which is a well-accepted and well-known process for securing components fabricated from synthetic plastic to each other.

The receptor means 18 includes an annular orifice 32 which has retention means 34 superimposed in overlying relationship therewith, said retention means incorporating locking means 36 constituted by a plurality of resilient, deformable prongs 38, said deformable prongs having planar upper extremities 42 for a purpose which will be described in greater detail below.

Cooperative with and constituting a part of the security fastener 10 is carrier means 50 constituted by a stud plate 52 having fastener means 54 formed thereupon and integrally therewith. The fastener means 54 are constituted by studs 56, said studs being spaced from each other and extending upwardly in a vertical orientation.

Each stud 56 includes a lower circumferential receptacle 58 for a purpose to be described in greater detail below and a substantially frusto-conical boss 62 which acts, in a manner to be described in greater detail below, to displace the prongs 38 and permit locking engagement of said prongs with the stud 56.

The upper extremity of the stud 56 is constituted by an enlarged annulus 64 which defines, on its underside, a land 66 which serves as detent means of the security fastener 10 in a manner to be described in greater detail below.

Figure 8:
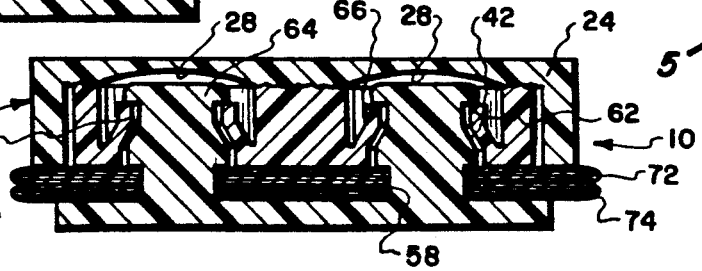
FIG. 8 is a sectional view taken on the broken line 8—8 of FIG. 7.
Figure 6:
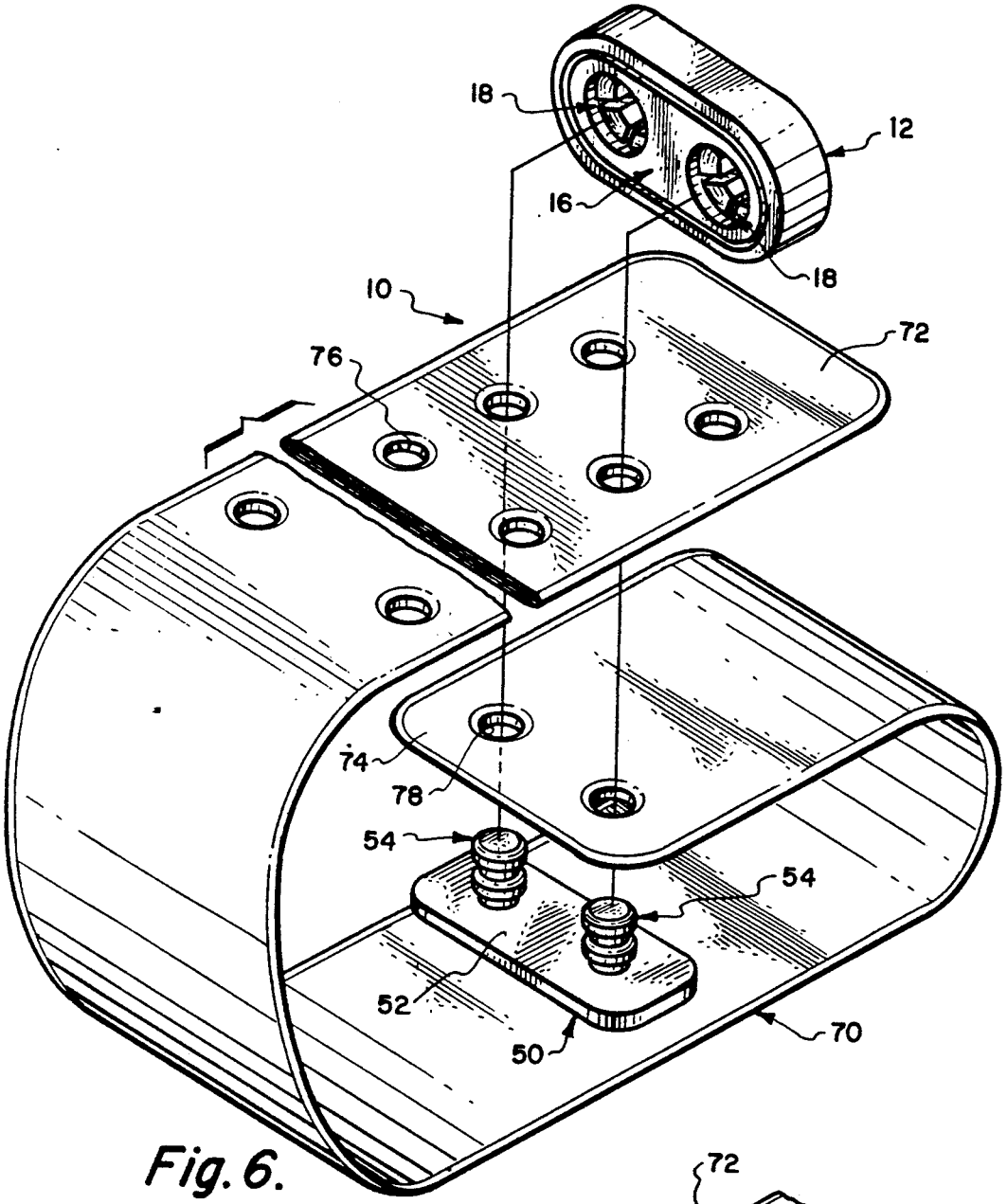
FIG. 6 is an exploded view showing an identification band of the '063 patent and the relationship of the components of the security fastener with the openings of said band prior to the affixation of said security fastener onto said band.
Figure 7:
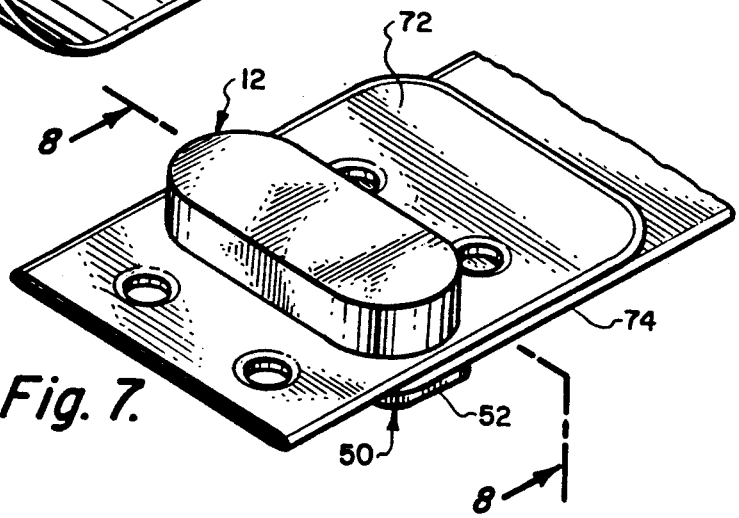
FIG. 7 illustrates the securement of the security fastener in operative relationship with said band.

The security fastener 10, as best shown in FIGS. 6–8 of the drawings, is designed for utilization with a security band 70 having opposite extremities 72 and 74 incorporating pairs of securement openings 76 and 78 respectively.

In order to install the security fastener 10 in operative relationship with the aforesaid openings 76 and 78, the studs 56 are inserted through the coincident selected openings 76 and 78 so that the frusto-conical boss 62 will momentarily expand the openings 76 and 78 causing the edges thereof to snap into the recesses 58 in the manner shown in FIG. 8 of the drawings.

Manifestly, when the opposite extremities 72 and 74 of the band are located in the recesses 58, the upper extremities of the studs 54 are located a substantial distance above the corresponding upper surface of the overlapping extremity 72. Therefore, the studs are located for engagement with the security capsule 12. This is accomplished by locating the orifices 32 in registration with the annuli 64 on the upper extremities of the studs 54 and forcing the shroud 14 of the capsule 12 downwardly to carry the mounting block 16 downwardly and the studs 54 into positions where the upper extremities 42 of the pronqs 38 will underlie the lands 66 on the upper extremities of the studs 56.

Engagement of the upper extremities 42 of the prongs 38 with the lands 66 locks the studs in the capsule 12, as best shown in FIG. 8 of the drawings, and, when so locked, the lower extremity of the skirt 24 of the shroud 14 engages the upper surface of the band extremity 72 and the inter-engagement of the component portions of the security fastener 10 is completely concealed. When the upper extremities of the studs 56 are secured in the capsule 12, the concavities 28 serve as clearance means for said upper extremities.

Moreover, a relatively massive and tamper-proof aspect is imparted by the shroud 14. In addition, the shroud can be manufactured in colors vividly contrasting with the color of the associated security bands and, if anyone should attempt to remove the capsule 12, immediate visual perception of the attempt to remove the capsule 12 will be apparent.

Although I have described the invention as including stud fastener means and prong receptor means, it will be obvious to those skilled in the art that fastener components other than those disclosed may be utilized without departing from the scope of the invention or the claims.

I claim:

1. In a security fastener for the non-releasable securement of an identification band characterized by overlying securement openings provided in overlying upper and lower extremities of said band, the combination of: carrier means located inside of said lower extremity of said band having fastener means thereupon, said fastener means incorporating detent means inserted through said securement openings, and projecting above the surface adjacent to the uppermost of said openings and receptor means for said detent means disposable in locking relationship with said fastener means, said receptor means including a security shroud, said shroud overlying the upper extremity of said band, and locking means engageable with said detent means to maintain said fastener means in operative relationship with said openings and said shroud in overlying relationship with said identification or other means.

2. The fastener of claim 1 in which said fastener means is constituted by a stud mounted on said carrier means and said detent means is provided on the upper extremity of said stud, said detent means being engagable by said receptor means when said stud is inserted through said openings.

3. The fastener of claim 2 in which said locking means provides a corresponding retention means engagable with said detent means of said stud.

4. The fastener of claim 1 in which said shroud encompasses and conceals said fastener means and said receptor means when said fastener means and said receptor means are engaged with each other.

5. In a security fastener for the non-releasable securement of an identification band characterized by overlying securement openings provided in overlying upper and lower extremities of aid band, the combination of: a stud plate located inside of said lower extremity of said band having stud means thereon, said stud means incoporating detent means larger than said openings which, when said stud is inserted through said opening expands the same, ad projects above the surface adjacent the uppermost of said openings; and a security capsule engagable in locking relationship with said detent means of said stud means said security capsule incorporting receptor means of said stud means, said receptor means having retention means thereupon engagable with said detent means to maintain said capsule in operative relationship with said stud means, said security capsule having a shroud which encompasses said stud means and said receptor means to prevent separation of said security capsule for said stud means unless said security capsule is visibly tampered with, said shroud overlying the upper extremity of said band.

6. The fastener of claim 5 in which said detent means on said stud means is a circumferential land on the upper extremity of said stud means.

7. The fastener of claim 5 in which said retention means includes a plurality of prongs whose extremities are engagable with said detent means of said stud means.

8. The fastener of claim 5 includes a circumferential land on said stud means engagable by prongs in said receptor means.

9. The fastener of claim 5 in which a plurality of stud means is provided on said stud plate and a plurality of receptor means is provided in said capsule.

* * * * *

UNITED STATES PATENT AND TRADEMARK OFFICE

CERTIFICATE OF CORRECTION

PATENT NO. : 5,226,809

DATED : July 13, 1993

INVENTOR(S) : Gino Franco

It is certified that error appears in the above-indentified patent and that said Letters Patent is hereby corrected as shown below:

At Column 1, Line 63, "mean" should be replaced with --means--.

At Column 2, Line 36, "component" should be replaced with --components--.

At Column 3, Line 66, insert the word --urge-- after the word "and".

Claim 5, at Column 4, Line 57, replace "aid" with --said--; Line 66, "of" should be replaced with --for--; Line 62, replace "ad" with--and--.

Signed and Sealed this

Fifth Day of April, 1994

Bruce Lehman

*Attest:*

BRUCE LEHMAN

*Attesting Officer*

*Commissioner of Patents and Trademarks*